US006381992B1

(12) United States Patent
Haltenhof

(10) Patent No.: US 6,381,992 B1
(45) Date of Patent: May 7, 2002

(54) METHOD OF AND DEVICE FOR TRANSFERRING STITCHES ON A KNITTING MACHINE

(75) Inventor: Hans-Guenther Haltenhof, Pfullingen (DE)

(73) Assignee: H. Stoll GmbH & Co., Reutlingen (DE)

( * ) Notice: Subject to any disclaimer, the term of this patent is extended or adjusted under 35 U.S.C. 154(b) by 0 days.

(21) Appl. No.: 09/707,533

(22) Filed: Nov. 7, 2000

(30) Foreign Application Priority Data

Nov. 12, 1999 (DE) ..... 199 54 477

(51) Int. Cl.[7] ..... D04B 7/04
(52) U.S. Cl. ..... 66/64
(58) Field of Search ..... 66/60 R, 64, 70, 66/71, 75.1, 76, 77, 78, 120, 96 R, 148

(56) References Cited

U.S. PATENT DOCUMENTS 5,343,719 A * 9/1994 Nakamori et al. ..... 66/64
5,367,892 A * 11/1994 Shima et al. ..... 66/64
5,398,527 A * 3/1995 Hirai et al. ..... 66/64
5,557,948 A * 9/1996 Shima et al. ..... 66/64
6,018,966 A * 2/2000 Shima ..... 66/64
6,047,569 A * 4/2000 Shima ..... 66/64
6,178,782 B1 * 1/2001 Takeda et al. ..... 66/64

FOREIGN PATENT DOCUMENTS

DE 24 43 231 3/1976
EP 0 103 033 A1 3/1984

* cited by examiner

*Primary Examiner*—Danny Worrell
(74) *Attorney, Agent, or Firm*—Michael J. Striker

(57) ABSTRACT

Transferring of stitches on a knitting machine with transfer elements includes associating a transfer element with all needles on which stitches are suspended, placing a stitch which is held in a needle and has to be transferred on a needle element, introducing the transfer element into the stitch, withdrawing the needle from the stitch, so that the stitch is suspended alone on the transfer element and is available for a transfer, and transferring the stitch to a further element.

18 Claims, 8 Drawing Sheets

METHOD OF AND DEVICE FOR TRANSFERRING STITCHES ON A KNITTING MACHINE

BACKGROUND OF THE INVENTION

The present invention relates to a method of and a device for transferring stitches on a knitting machine by transfer elements.

In all known methods for transferring of stitches, the needles which hold the stitches to be transferred are advanced so far that the stitches slide over the open latch; or the slide of the needle until they are placed on the needle shaft. There the stitch is spread by a spreading spring, so that subsequently it can be taken by a needle of the opposite needle bed or also by transfer fingers. Such methods are disclosed for example in German patent document DE-OS. 24 43 231 and European patent document EP 0 103 033 A1.

The known methods have the disadvantage that a great needle advance distance is required. The control curves which are needed for this purpose require correspondingly wide knitting cams. Moreover, the wide needle advance stroke leads to a reduction of the production speed of the knitting products. The main disadvantage of the known methods is however that the stitches, before the transfer to a neighboring needle or a transfer finger, are pulled far from the stitch structure and spread out, so that sensitive yarns are used for splitting the stitches. The transferred stitches moreover are increased by the transfer process, so that this is visible in smooth knitting products in the overall knitting pattern and therefore the quality of the knitted product is limited.

SUMMARY OF THE INVENTION

Accordingly, it is an object of present invention to provide a method of and a device for transferring stitches, which avoid the disadvantages of the prior art.

More particularly, it is an object of the present invention to provide a method of and a device for transferring of stitches, which avoid a high yarn loading and an increase in production time for producing knitted articles.

In keeping with these objects and with others which will become apparent hereinafter, one feature of present invention resides, briefly stated, in a method of transferring stitches on a knitting machine by means of transferring elements, in which a transfer element is associated with all needles on which stitches must be suspended, wherein in accordance with the present invention the stitches held in the needles and to be transferred are placed by needle advance and return movements on the needle ledge or, in case of slide needles, on the closed needle slide, and subsequently the transfer element is inserted into the stitch and the needle is pulled out of the stitch, so that the stitch is suspended alone on the transfer element and is available for transfer on the same or other needle or on another transfer element.

For placing, the stitches on the ledge or on the slide, needle movements are needed as required in normal stitch forming processes. The further advance of the needle to which the stitch is transferred in accordance with the known methods is no longer needed. In the inventive method the stitch is sufficiently clamped by the needle ledge over the needle slide so that the tip of the transfer element can be introduced into the stitch. However, no additional spreading of the stitch when compared with the conventional, not suspended stitch is carried out, so that also no significant increase of the suspended stitch takes place, which can be seen later in the knitted pattern.

For placing of the stitch, different possibilities are provided. The stitch can be placed by a needle advance and subsequent needle return movement on the closed ledge of the needle. It suffices that the needle is advanced so far that the stitch is located behind the open ledge. The stitch can be placed however also by a needle advance movement on the open ledge of the needle. Both, in the case of the open as well as closed ledge, the stitch is sufficiently clamped, so that the transfer element can be inserted into the stitch.

With the use of the slide needles, the stitch can be placed by a needle advance movement with the open slide and a subsequent needle return movement with the closed slide, over the closed slide.

Similar conditions are provided for the transfer process as during placing of the stitch on the closed ledge of a ledge needle. The inventive method for transferring of stitches can be utilized both on flat knitting machines and also on round knitting machines.

The inventive device for transferring stitches on a knitting machine in accordance With the inventive method has an associated transfer element for all needles on which stitches are suspended, and in accordance with the present invention the transfer element has a tip which is formed by at least one plate spring. With the use of the plate spring tip it is possible to provide insertion into stitches which are clampingly held on the ledges or on the slides. The plate spring is introduced in the thread space and runs between the legs of the stitch.

In accordance with a preferable embodiment of the invention, the transfer element cans have a tip formed by two plate springs. One plate spring is displaceable over the left side and the other plate spring is displaceable over the right side of the needle ledge or the needle slide and is insertable between the stitch legs. With such a design, the tip engages with stitch symmetrically left and right of the needle shaft, and the transfer of the stitch to the transfer element is even more reliable. After the return of the needle from the stitch, the both plate spring elements are compressed and together form the tip of the transfer element.

In a transfer device for a flat knitting machine, the transfer element is supported longitudinally displaceably in at least one sinker arranged over the at least one needle bed of the flat knitting machine. For this purpose the at least one sinker is provided with grooves, in which the transfer elements are longitudinal displaceable. The transfer elements have the same distance from one another as the needles of the at least one needle bed. Thereby it is guaranteed that a transfer element is exactly associated with each needle.

When the at least one needle bed of the flat knitting machine is supported not longitudinally displaceably, the at least one sinker is supported longitudinally displaceably on the knitting machine. Thereby a lateral offset of the stitches through the transferring process is possible With the longitudinally displaceable needle beds, the sinker with the transfer elements can be also arranged fixedly.

With a multi-bed knitting machine it is advantageous when for each needle bed of the flat knitting machine at least one sinker with transfer elements is provided. The sinker can be provided over its whole length with transfer elements, or only in its partial regions. Moreover, it is naturally possible, to provide for each needle bed several sinkers in such regions, in which the transfer process must be carried out.

The transfer elements can be controllable preferably similarly as the needles of the flat. knitting machine, in particular by control curves or cams, in which projections arranged on the transfer elements engage. It is advantageous when these control curves are arranged on the slide or slides for needle control of the flat knitting machine. Again, no separate drive for selection of the transfer elements is needed.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1A:
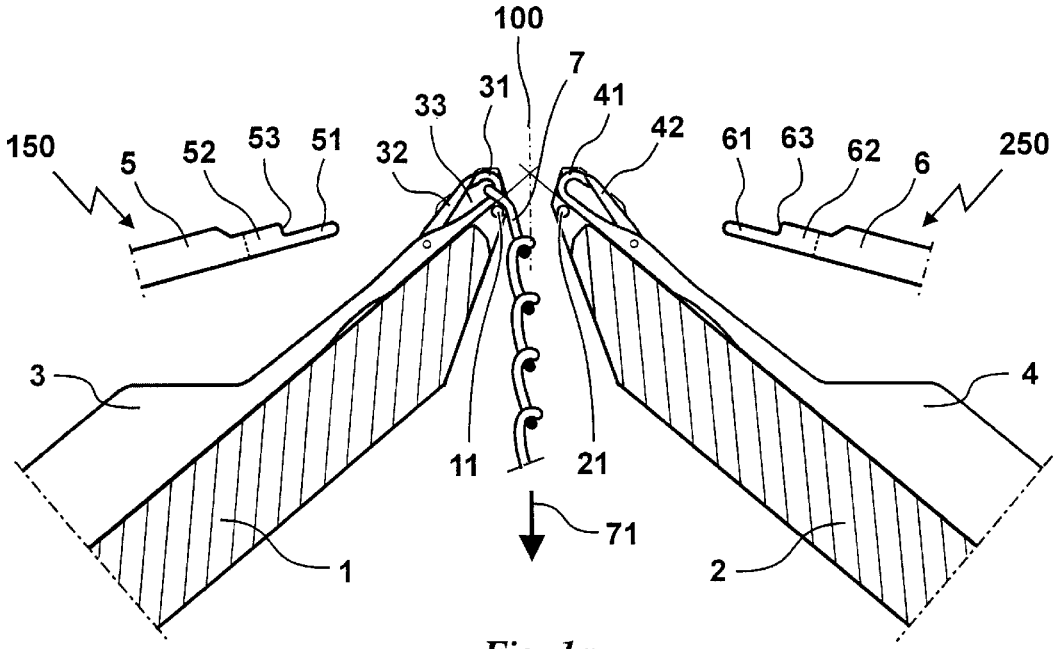
FIGS. 1*a*–1*f* are views showing partial sections through front and rear needle beds of a flat knitting machine with an inventive transfer device in different needle and transfer element positions, during transfer of a stitch to the transfer element in accordance with the inventive method.

FIG. 1 shows a front needle bed 1 and a real needle bed 2 of a flat knitting machine. Latch needles 3 are longitudinally displaceably supported in the front needle bed 1 and similarly latch needles 4 are longitudinally displaceably supported in the rear needle bed 2. Transfer elements 5 and 6 are arranged over the needle beds 1 and 2 with the needles 3 and 4, for transferring of stitches. In the shown example the needle 3 holds a stitch 7 in its thread space 33 which is formed by a needle hook 31 as well as a closed needle latch 32. The transfer element 5 associated with the needle 3 is a part of a stitch transfer device 150 which is not shown in detail. The transfer element 5 has a tip 51 with a front surface 53. In FIG. 1*a* the needle 3 is located in its basic position, or in other words the stitch 7 abuts against a knocking over base 11 of the front needle bed 1 under the action of the knitting product pull in direction of the arrow 71.

Figure 1B:
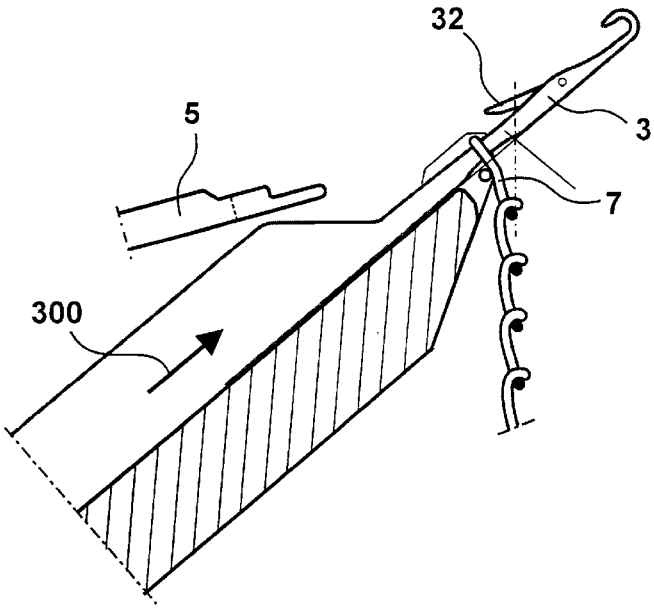
Figure 1C:
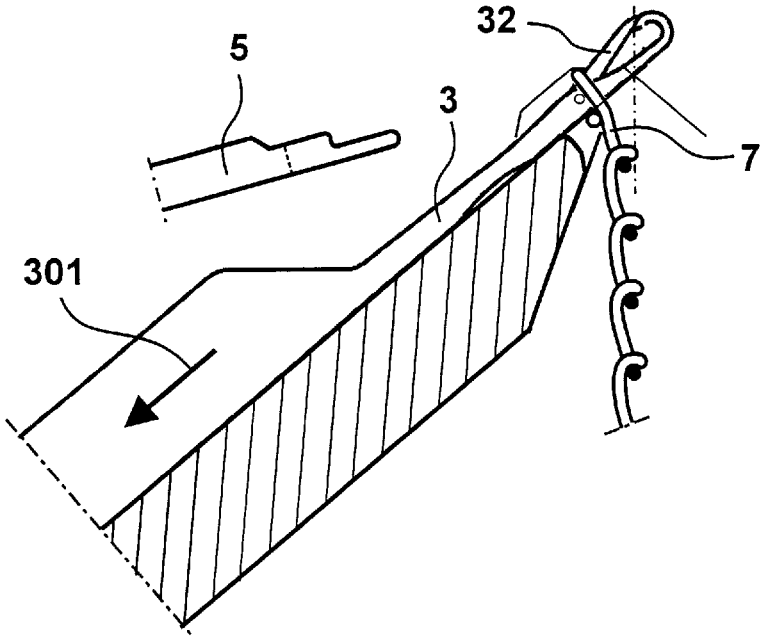

In FIG. 1*b* the needle 3 is driven out or advanced in direction of the arrow 300. Thereby the needle latch 32 is open through the stitch 7, and the stitch 7 is now located on the needle shaft behind the open latch 32.

Figure 1D:
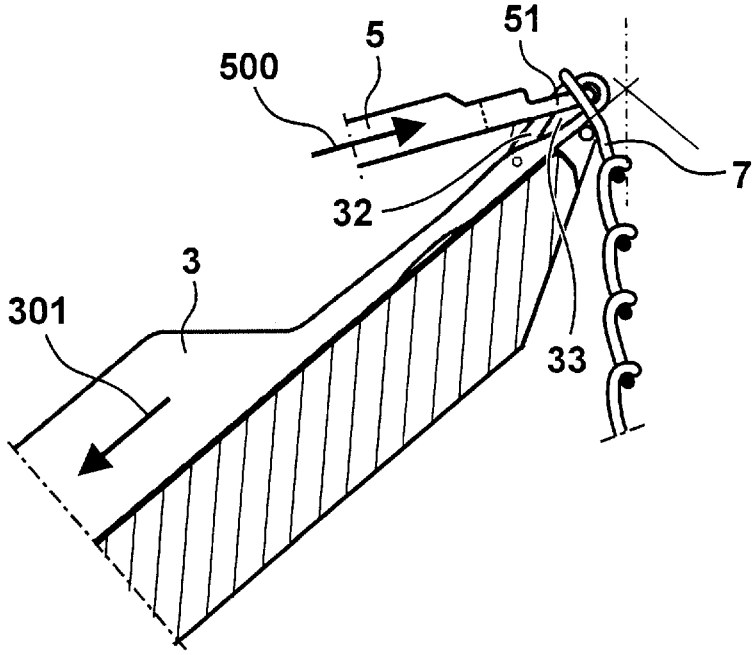

Subsequently as can be seen from FIG. 1, the needle 2 is pulled back in direction of the arrow 301 until the stitch 7 during a forward sliding on the needle 3 again closes the latch 32 and comes to abutment against the closed latch 32. This position is shown in FIG. 1*d*. The needle 3 is pulled back in the direction of arrow 301 so far that the stitch is located shortly before its knocking off position (transfer position). The stitch 7 is now clamped by the needle head with the closed latch 32 so far, that the transfer element 5 is advanced in direction of the arrow 500 and can be inserted into the stitch 7. The tip 51 of the transfer element 5 thereby slides laterally on the rear of the latch 32 and so far into the spring thread space 33 (FIG. 1*a*) of the needle 3 that it extends at the inner side of the leg through the stitch 7.

Figure 1E:
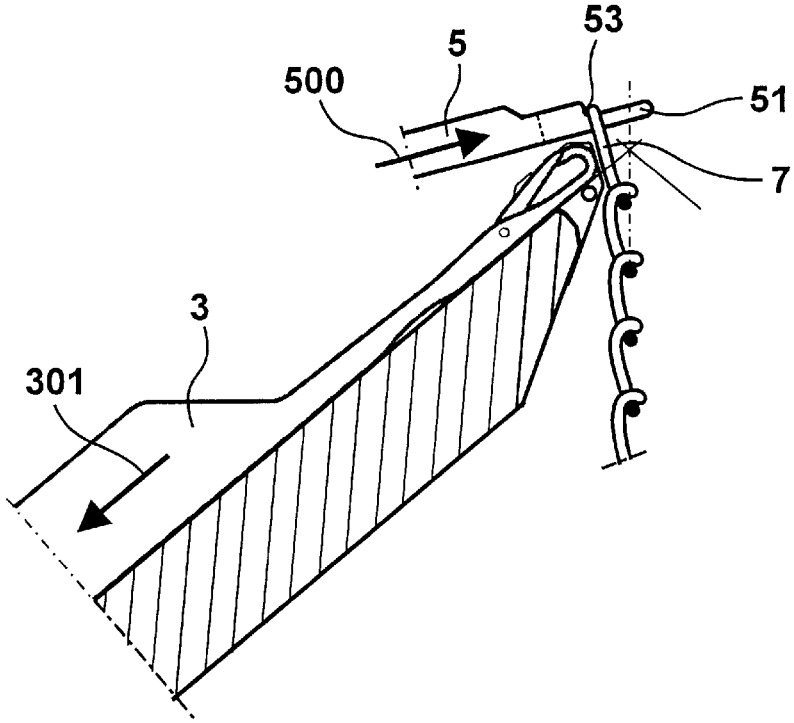

Subsequently the needle 3 is pulled back in direction of the arrow 301 to its basic position and thereby the stitch 7 is released as shown in FIG. 1*e*. Simultaneously, the transfer element 5 is driven so far in direction of the arrow 500 until the stitch 7 abuts against the front region 53. The stitch 7 is now transferred from the transfer element 5.

Figure 1F:
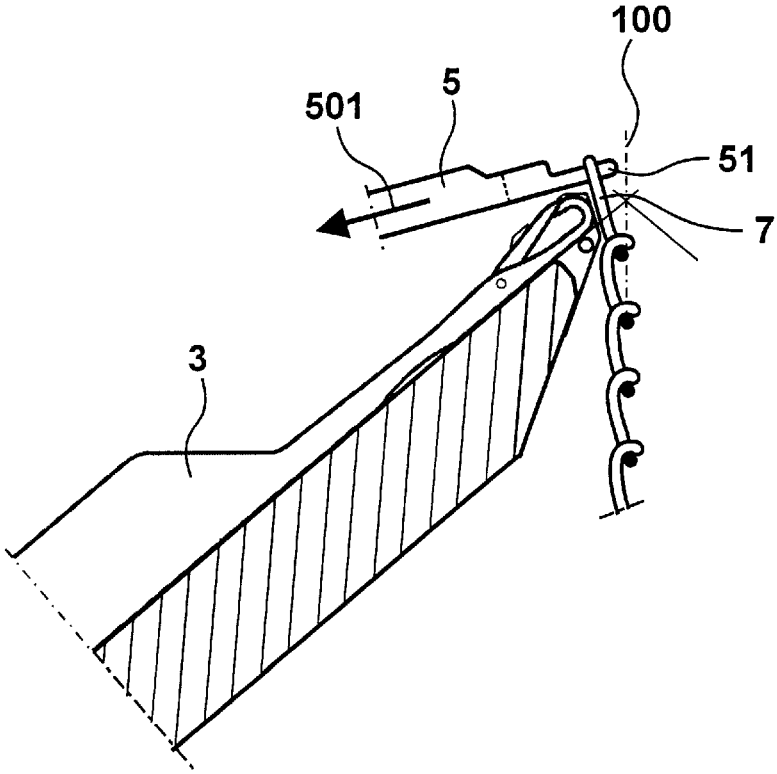

When the stitch 7, which now is suspended on the transfer element 5, temporarily must not take part in the knitting process, the stitch transfer element 5 can be pulled back in direction of the arrow 501, so that the stitch 7 is suspended on the tip 51, and the tip 51 is however located behind the central axis 100 of the knitting machine. Moreover, the transfer element 5 can be offset laterally via the needle 3 by a half pitch, and the needle 3 can take part in the knitting process so that the stitch 7 located on the transfer element 5 does not hinder the knitting process as shown in FIG. 1*f*.

Figure 3A:
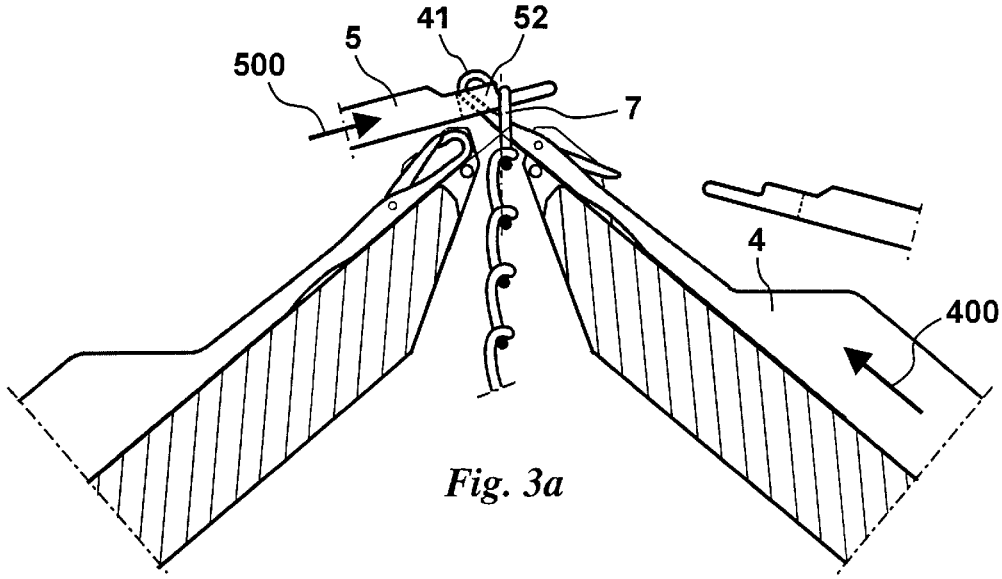
FIGS. 3*a*–3*c* are views showing a partial cross-section through the front and rear needle bed of a flat knitting machine with an inventive transfer device in different needle and transfer positions during transfer of a stitch on a needle of the rear needle bed.
Figure 3B:
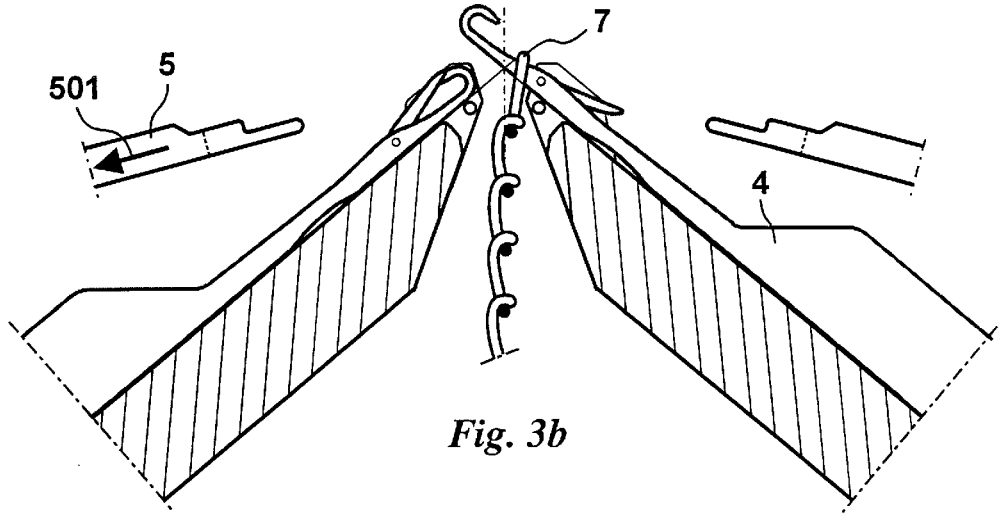
Figure 3C:
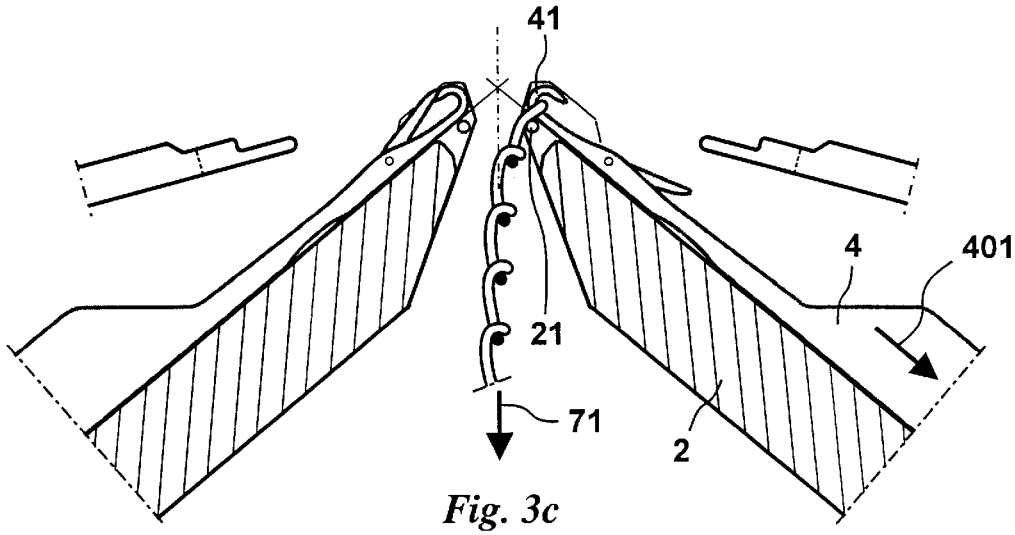
Figure 4A:
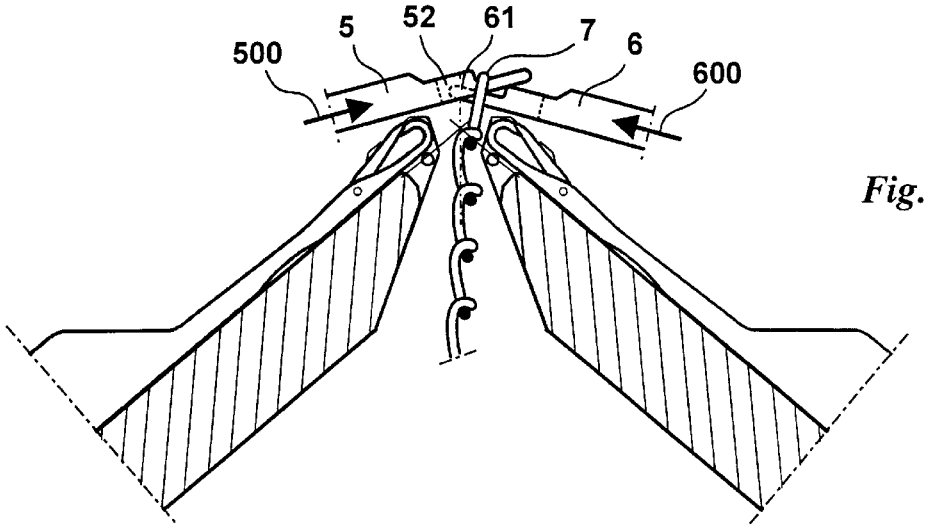
FIGS. 4*a*–4*c* are views showing a partial cross-section through the front and rear needle bed of a flat knitting machine with an inventive transfer device in different transfer element positions during transfer of a stitch from one transfer element to another transfer element.

FIGS. 2, 3 and 4 show the transfer of the stitch 7 suspended on the transfer element 5 to the same needle 3 or another needle of the same needle bed 1 as shown in FIG. 2, on the needle 4 on the opposite needle bed 2 as shown in FIG. 3, and on an oppositely located transfer element 6 as shown in FIG. 4.

Figure 2A:
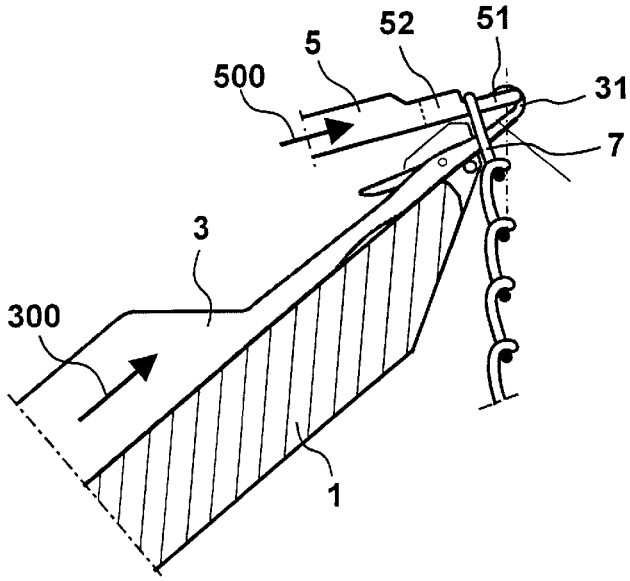
FIGS. 2*a*–2*c* are views showing a partial cross-section through the front needle bed of a flat knitting machine with an inventive transfer device in different needle positions and transfer element positions, during transfer of a stitch on a needle of the front needle bed.
Figure 2B:
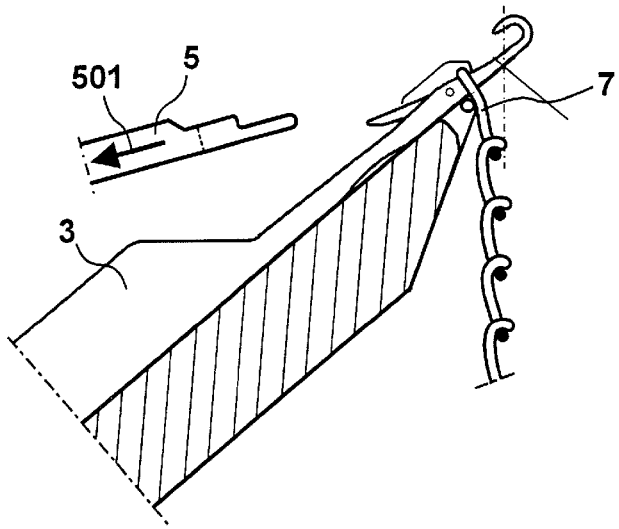
Figure 2C:
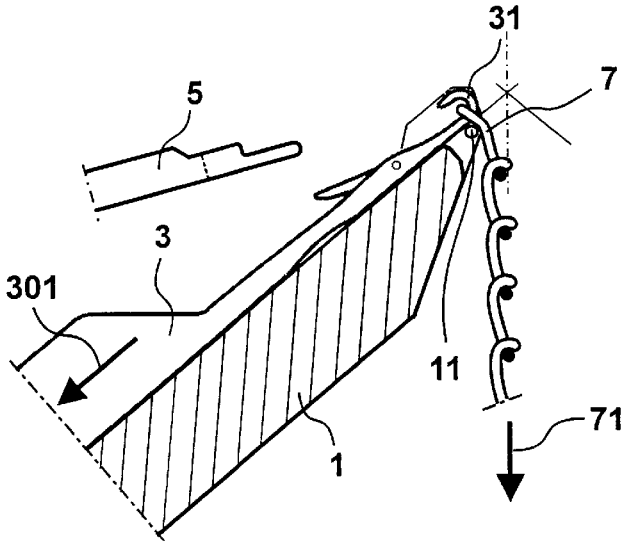

In FIG. 2*a* the stitch transfer element 5 is driven in direction of the arrow 500 to its transfer position for the needle 3 of the same needle bed 1. The needle 3 is driven in direction of the arrow 300 so far, until the needle hook 31 is introduced into the stitch transfer element 5 in the region 52 and is located in the region of the tip 51. With this process the needle hook 31 slides through the legs of the stitch 7. In accordance with FIG. 2*b*, subsequently the stitch. transfer element 5 is completely withdrawn in direction of the arrow 501, so that the stitch 7 now is suspended on the needle 3. Then the needle 3 moves in direction of the arrow 301 again to its basic position, so that the stitch 7 is suspended in the needle hook 31 and abuts against the knocking off base 11 shown in FIG. 2*c*.

During the transfer process of the stitch 7 to the needle 4 of the opposite needle bed shown in FIG. 3, the needle 4 in accordance with FIG. 3*a* is driven in direction of the arrow 400 so far that it is inserted with its needle hook 41 in a section 52 of the stitch transfer element 5, which is located in the transfer position for needles of the opposite needle bed. During this process the needle hook 40 slides through the legs of the stitch 7. Subsequently, as shown in FIG. 3*b* the transfer element 5 is pulled back in direction of the arrow 501, so that now the stitch 7 is suspended alone on the needle 4. The needle 4 is subsequently (FIG. 3*c*) pulled back in direction of the arrow 401 to its basic position, so that the stitch 7 abuts against the knocking off base of the rear needle bed 2.

Figure 4B:
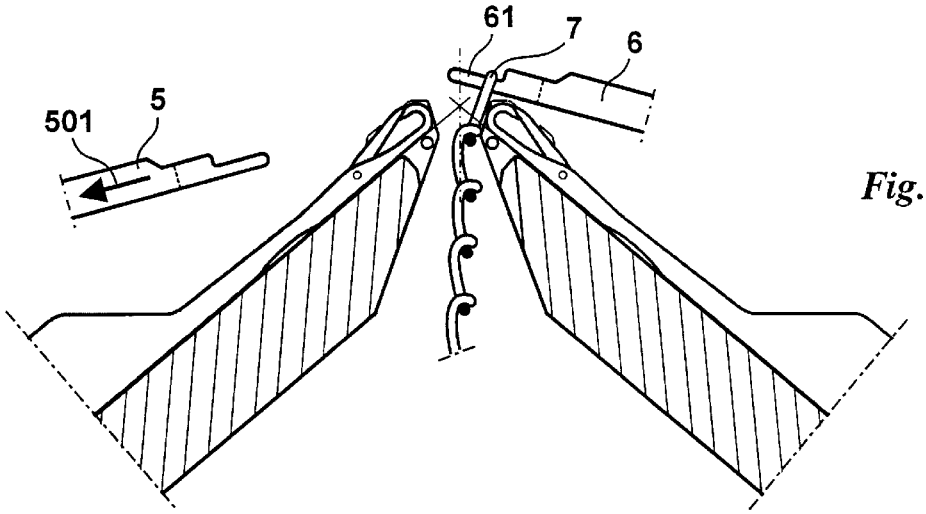
Figure 4C:
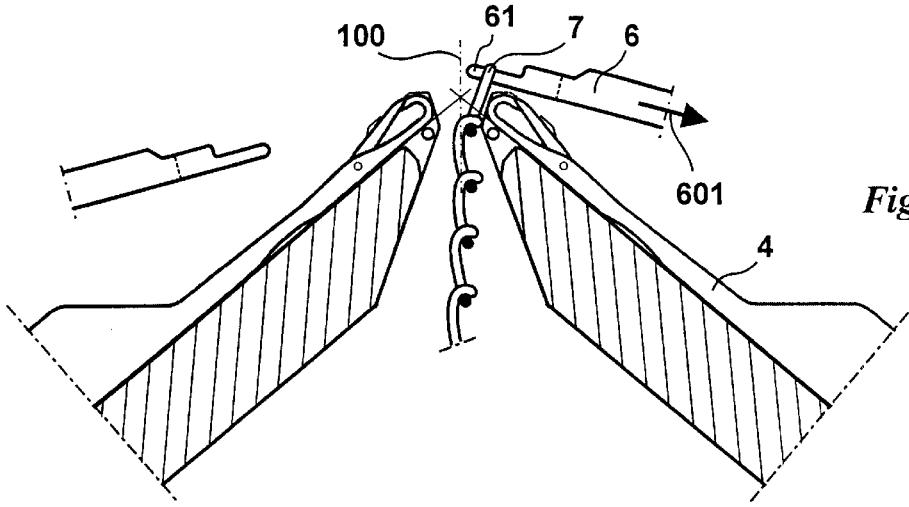

During the transfer of the stitch 7 from the transfer element 6 in accordance with FIG. 4, both transfer elements 5 and 6 are advanced in direction of the arrows 500 and 600 so far, that the stitch transfer element 6 with its top 61 is introduced into the section 52 of the stitch transfer element 5 and thereby slides with its tip 61 through the length of the stitch 7. Subsequently, in accordance with FIG. 4*b* the stitch transfer element 5 is completely withdrawn in direction of the arrow 501 so that the stitch 7 now is suspended alone on the transfer element 6. In accordance with FIG. 4*c*, then the transfer element 7 is pulled back in direction of the arrow 601 so far that the stitch 7 is suspended again on the tip 61, while the tip 61 however is located behind the central axis 100 of the knitting machine. When the needle 4 associated with. the transfer element 6 must take part in a further knitting process but the stitch 7 must be held for a certain time on the transfer element 6, the needle 4 and the transfer element 6 can be offset relative to one another by a half pitch, so that the stitch 7 releases the advance space of the needle 4.

Figure 5:
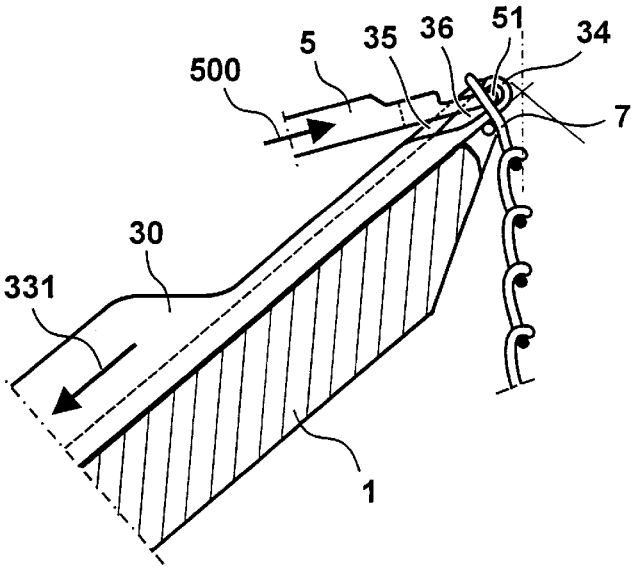
FIG. 5 is a view showing a partial cross-section through the front needle bed of a flat knitting machine with slide needles with an inventive transfer device.

FIG. 5 illustrates the transfer of the stitch 7 from a slide needle 30. The slide 35 of the needle 30 and thereby also the thread space 36 are closed. The needle 30 is pulled back so far in direction of the arrow 331 that it is located in the transfer position, or in other words the stitch 7 is located on the closed slide 35. The transfer element 5 is driven in the direction of the arrow 500 so far that its tip 51 is introduced in the thread space 36 and thereby between the legs of the stitch 7. By this introduction of the tip 51 of the transfer element 5 into the thread space 36, the inventive transfer process and the inventive transfer device can be used both for latch and for slide needles.

Figure 6:
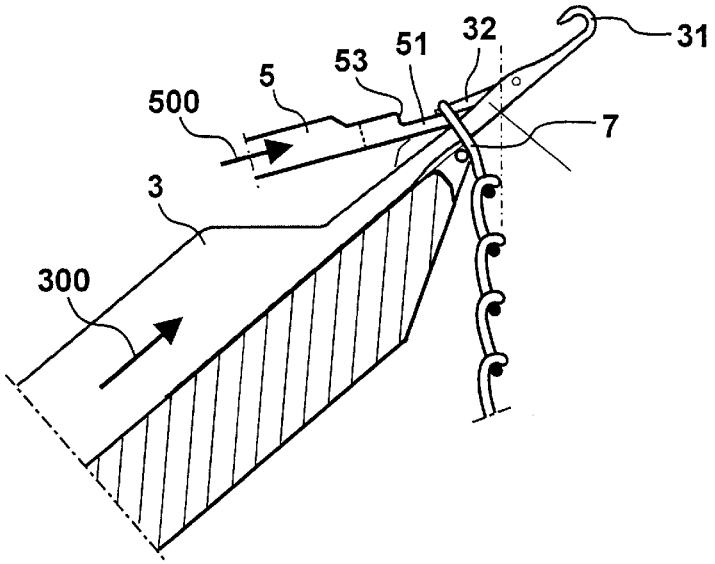
FIG. 6 is a view showing a partial cross-section through the front needle bed with a flat knitting machine with an inventive transfer device during transfer of a mesh located on an open latch needle, to a transfer element.

FIG. 6 shows a further variant of a transfer of a stitch 7 by the stitch transfer element 5 for latch needles 3. The needle 3 is driven in direction of the arrow 300 to its stitch transfer position, in which the stitch 7 comes to lie on the open latch 32. Also, in this position the stitch 7 is clamped. Moreover, a free space between the open latch spoon and the needle shaft is formed. The transfer element 5 is driven in direction of the arrow 500 with its tip 51 into the free space. The tip extends now between the length of the stitch 7 and therefore can take the stitch.

Figure 7A:
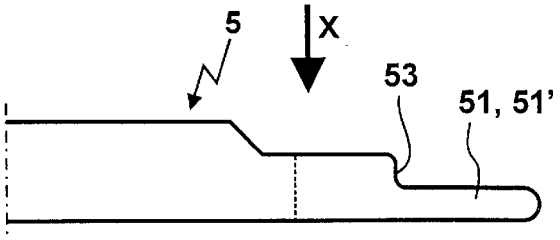
FIGS. 7*a*, 7*b* are detailed views of a transfer element in accordance with the present invention.
Figure 7B:
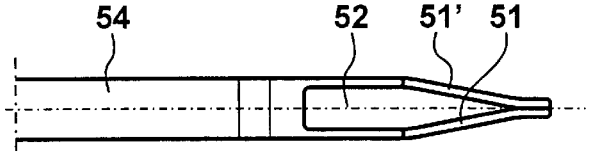
Figure 8:
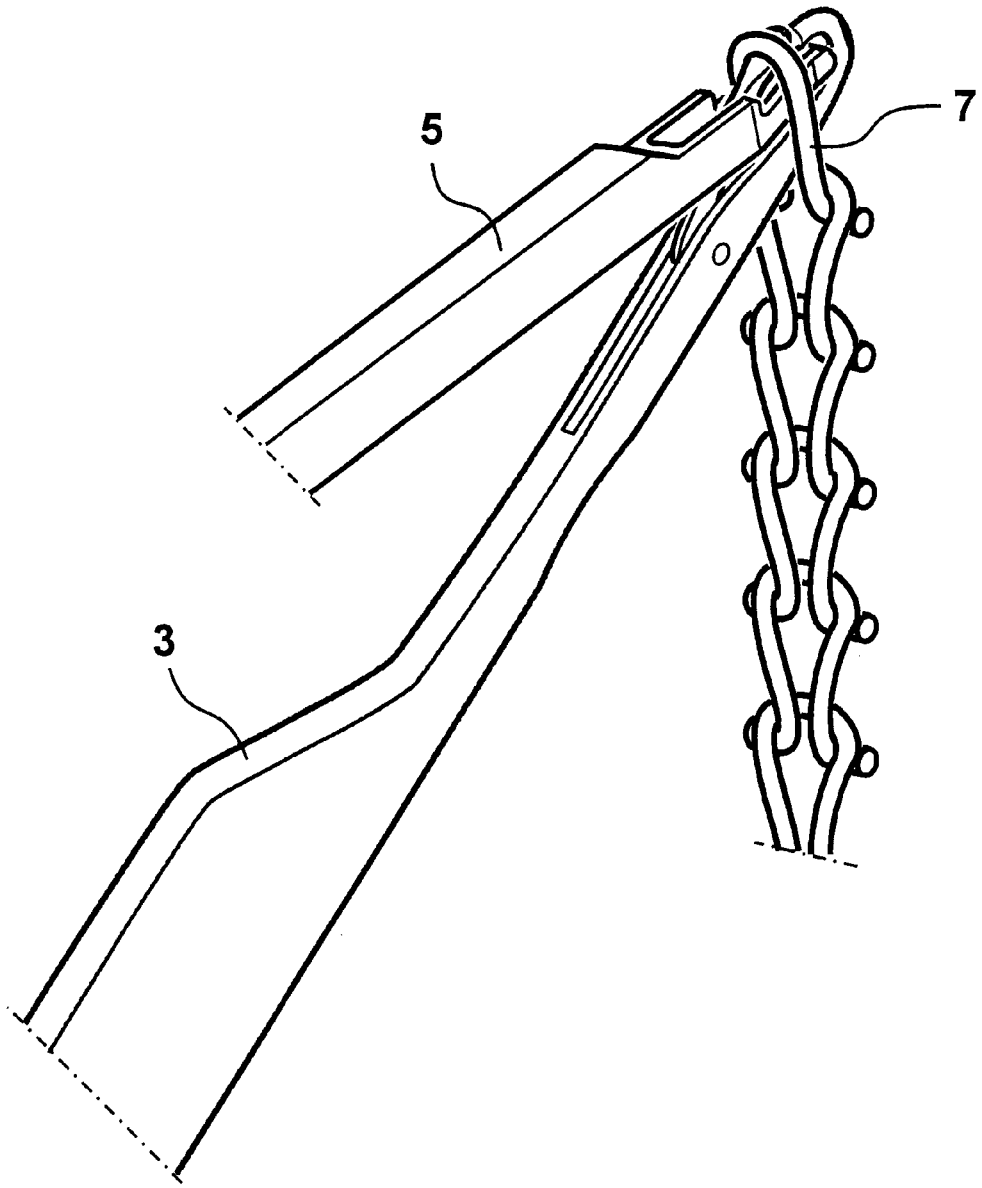
FIG. 8 is a schematic perspective view of a stitch transfer with the transfer element of FIG. 7.

FIGS. 7*a*, 7*b* and 8 illustrate a preferable embodiment of a transfer element 5. FIG. 7*a* shows the side view and FIG. 7*b* the plan view of the transfer element 5. FIG. 7*b* shows that the tip 51 of the transfer element 5 is also a double tip of two plate spring elements 51 and 51'. The plate spring element 51 and 51' are located over one another on the tip. In its rear region, a hollow space 52 is enclosed, in which the needle head of a needle 3, 4 can be inserted, for taking the stitch 7 which is suspended on the transfer element 5. The stitch 7 is supported on the front face 53 after the transfer. The transfer element 5 also has a massive shaft 54, which is longitudinally displaceable in a groove of a not shown sinker and can be controlled by a control cam.

FIG. 8 illustrates in a perspective view the transfer of the stitch 7 from the needle 3 by the transfer element 5. The tip 51, 51' of the transfer element extends. into the thread space of the needle 3.

It will be understood that each of the elements described above, or two or more together, may also find a useful application in other types of constructions differing from the types described above.

While the invention has been illustrated and described as embodied in method of .and device for transferring stitches on a knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A method for transferring stitches on a knitting machine with transfer elements, comprising the steps of associating a transfer element with all needles on which stitches are suspended, wherein the needles are arranged on at least one needle bed; placing a stitch which is held in a needle and has to be transferred on a needle element; introducing the transfer element into the stitch; withdrawing the needle from the stitch, so that the stitch is suspended alone on the transfer element and is available for a transfer; and transferring the stitch to a further element, wherein the transferring step includes transferring the stitch from a first needle of a first needle bed to a needle of a second needle bed and from said first needle of the first needle bed to a second needle of the first needle bed or wherein said transferring step includes transferring the stitch to another transfer element.

2. A method as defined in claim 1, wherein said placing includes placing he stitch by needle advance and/or return movements on the needle element formed as a needle latch.

3. A method as defined in claim 1, wherein said placing includes placing the stitch by slide needles on the needle element formed as a needle slide.

4. A method as defined in claim 1, wherein said transfer includes transferring to a needle selected from the group consisting of a same needle and another needle.

5. A method as defined in claim 1, wherein said transferring includes transferring to another transfer element.

6. A method as defined in claim 2, wherein said placing includes placing the stitch by the needle advance and subsequent needle return movement on a closed latch of the needle.

7. A method as defined in claim 2, wherein said placing includes placing the stitch by a needle advance movement to an open latch of the needle.

8. A method as defined in claim 3, wherein said placing includes placing the stitch by a needle advance movement with an open slide and a subsequent needle return movement with a closed slide over the closed slide.

9. A device for transferring stitches on a knitting machine, comprising means for associating a transfer element with all needles on which stitches are suspended; means for placing a stitch which is held in a needle and has to be transferred on a needle element; means for introducing the transfer element into the stitch; means for withdrawing the needle from the stitch, so that the stitch is suspended alone on the transfer element and is available for a transfer; and means for transferring the stitch to a further element.

10. A device as defined in claim 9, wherein said transverse element has a tip which is formed by at least one plate spring.

11. A device as defined in claim 9, wherein said transverse element has a tip which. is formed by two plate springs, so that one plate spring is displaceable over a left side and another plate spring is displaceable over a right side of said needle element and insertable between stitch legs.

12. A device as defined in claim 9; and further comprising at least one sinker arranged over at least one needle bed, said transfer element being supported displacably in said at least one sinker.

13. A device as defined in claim 12, wherein said at least one sinker is provided with. grooves in which said transfer elements are longitudinally displaceably supported, said transfer elements having same distances from one another as said needles of said at least one needle bed.

14. A device as defined in claim 12, wherein said at least one sinker is supported longitudinally displaceably on the knitting machine.

15. A device as defined in claim 12; and further comprising at least one said sinker for: said transfer elements for each needle bed of the knitting machine.

16. A device as defined in claim 9; and further comprising means forming control curves for controlling said transfer element, said control curves having projections engaging in said control curves.

17. A device as defined in claim 16; and further comprising a slide, said control curves being arranged on said slide for controlling the needles.

18. A device as defined in claim 16; and further comprising slides, said control curves being arranged on said slides for needle control.

* * * * *